US007978087B2

(12) United States Patent
Siber et al.

(10) Patent No.: US 7,978,087 B2
(45) Date of Patent: Jul. 12, 2011

(54) FIRE DETECTOR

(75) Inventors: Bernd Siber, Glonn (DE); Andreas Hensel, Egmating (DE); Ulrich Oppelt, Zorneding (DE); Jack McNamara, Pittsford, NY (US)

(73) Assignee: Robert Bosch GmbH, Stuttgart (DE)

( * ) Notice: Subject to any disclaimer, the term of this patent is extended or adjusted under 35 U.S.C. 154(b) by 523 days.

(21) Appl. No.: 10/586,208

(22) PCT Filed: Nov. 23, 2004

(86) PCT No.: PCT/EP2004/053047

§ 371 (c)(1),
(2), (4) Date: Jul. 13, 2006

(87) PCT Pub. No.: WO2005/069242

PCT Pub. Date: Jul. 28, 2005

(65) Prior Publication Data

US 2008/0258925 A1 Oct. 23, 2008

(30) Foreign Application Priority Data

Jan. 13, 2004 (DE) ..... 10 2004 001 699

(51) Int. Cl.
*G08B 17/10* (2006.01)

(52) U.S. Cl. ..... 340/630; 250/574; 340/577

(58) Field of Classification Search ..... 340/630, 340/577; 250/574
See application file for complete search history.

(56) References Cited

U.S. PATENT DOCUMENTS

| | | | | | |
|---|---|---|---|---|---|
| 4,121,110 | A | * | 10/1978 | Solomon | 340/630 |
| 4,166,960 | A | * | 9/1979 | Meili | 250/574 |
| 4,642,471 | A | | 2/1987 | Guttinger et al. | |
| 4,728,801 | A | * | 3/1988 | O'Connor | 250/573 |
| 4,769,550 | A | * | 9/1988 | Dolnick | 250/574 |
| 4,870,394 | A | * | 9/1989 | Corl et al. | 340/630 |
| 5,008,559 | A | * | 4/1991 | Beyersdorf | 250/575 |
| 5,280,272 | A | * | 1/1994 | Nagashima et al. | 340/630 |
| 5,381,130 | A | * | 1/1995 | Thuillard et al. | 340/630 |
| 5,451,931 | A | * | 9/1995 | Muller et al. | 340/630 |
| 5,477,218 | A | * | 12/1995 | Manmoto et al. | 340/630 |
| 5,568,130 | A | * | 10/1996 | Dahl | 340/630 |
| 5,576,697 | A | * | 11/1996 | Nagashima et al. | 340/630 |
| 5,581,241 | A | * | 12/1996 | Kaufman et al. | 340/630 |
| 5,587,790 | A | * | 12/1996 | Nagashima | 356/338 |
| 5,623,253 | A | * | 4/1997 | Narumiya et al. | 340/630 |
| 5,898,377 | A | * | 4/1999 | Adachi | 340/630 |
| 6,011,478 | A | * | 1/2000 | Suzuki et al. | 340/630 |
| 6,218,950 | B1 | * | 4/2001 | Politze et al. | 340/630 |
| 6,239,710 | B1 | * | 5/2001 | Oppelt | 340/630 |
| 6,515,589 | B2 | * | 2/2003 | Schneider et al. | 340/630 |
| 6,876,305 | B2 | * | 4/2005 | Kadwell et al. | 340/630 |
| 6,914,535 | B2 | * | 7/2005 | Matsukuma et al. | 340/630 |
| 7,224,284 | B2 | * | 5/2007 | Mi et al. | 340/630 |
| 2002/0060632 | A1 | | 5/2002 | Kadwell et al. | |
| 2002/0153499 | A1 | | 10/2002 | Oppelt et al. | |
| 2008/0211681 | A1 | * | 9/2008 | Muller et al. | 340/628 |
| 2008/0246623 | A1 | * | 10/2008 | Nagashima | 340/630 |

FOREIGN PATENT DOCUMENTS

DE 199 12 911 10/2000

(Continued)

*Primary Examiner* — George A Bugg
*Assistant Examiner* — Bradley E Thompson
(74) *Attorney, Agent, or Firm* — Kenyon & Kenyon LLP

(57) ABSTRACT

A fire detector operating by the scattered radiation principle is described, having at least one radiation transmitter and at least one radiation receiver, whose beam paths form a scattering volume. The fire detector includes, in addition to at least one first radiation transmitter and one first radiation receiver, at least one second radiation transmitter and one second radiation receiver, whose beam paths form at least two spatially separated scattering volumes.

29 Claims, 5 Drawing Sheets

FOREIGN PATENT DOCUMENTS

| | | |
|---|---|---|
| DE | 100 46 992 | 6/2002 |
| JP | 58203882 | 11/1983 |
| JP | 59501879 T | 11/1984 |
| JP | 4260197 | 9/1992 |
| JP | 7-151680 | 6/1995 |
| JP | 2000-187786 | 7/2000 |

* cited by examiner

FIRE DETECTOR

FIELD OF THE INVENTION

The present invention relates to a fire detector.

BACKGROUND INFORMATION

An optical fire detector, including a radiation transmitter and a radiation receiver, which manages without an optical labyrinth and may thus be installed flush in a ceiling, is described in German Patent Application No. DE 199 12 911 C2. Furthermore, the fire detector includes a system, using which soiling of the transparent cover plate of the fire detector may be recognized and, in addition, it may be monitored whether the radiation transmitter and radiation receiver of the fire detector provided for recognizing smoke still operate correctly. The conventional fire detector has the disadvantage that in addition to the radiation transmitter and radiation receiver provided for recognizing smoke, further radiation transmitters and radiation receivers are necessary for recognizing soiling and for function checking. Overall, at least three radiation transmitters and three radiation receivers are thus necessary.

A fire detector having a system, using which it is possible to differentiate between smoke and other foreign bodies in the scattering volume, is described in German Patent Application No. DE 100 46 992 C1. A significant complexity is also necessary in this known fire detector for differentiating between smoke and other foreign bodies, which makes manufacturing of a fire detector of this type more expensive.

SUMMARY

The present invention relates to a fire detector which includes manifold functions and is distinguished by particularly high operational reliability in spite of a reduced complexity. The objects described in both of the publications cited with regard to the related art may be achieved simultaneously using only three radiation transmitters and three radiation receivers in this case. Because at least one of multiple scattering volumes includes at least a partial area of a cover plate that terminates the fire detector, soiling of the cover plate may be recognized reliably. Through selective controllability of the radiation transmitters and radiation receivers using a microcomputer, the reliability performance of the radiation transmitters and radiation receivers of the fire detector may be checked easily. Furthermore, it is possible to differentiate between smoke and objects in front of the fire detector. By analyzing the scattered radiation measured values of scattering volumes which have different distances from the cover plate, the fire detector designed according to the present invention may differentiate various types of smoke from one another and therefore also better differentiate between signals originating from smoke and interference. Through comparison of scattered light measured values obtained at different instants, changes in the ambient temperature or aging effects may be recognized reliably and compensated for using appropriate correction factors. Finally, the fire detector also displays an even lower sensitivity to interfering radiation.

BRIEF DESCRIPTION OF THE DRAWINGS

Example embodiments of the present invention are described in greater detail below with reference to the figures.

DETAILED DESCRIPTION OF EXAMPLE EMBODIMENTS

Figure 1:
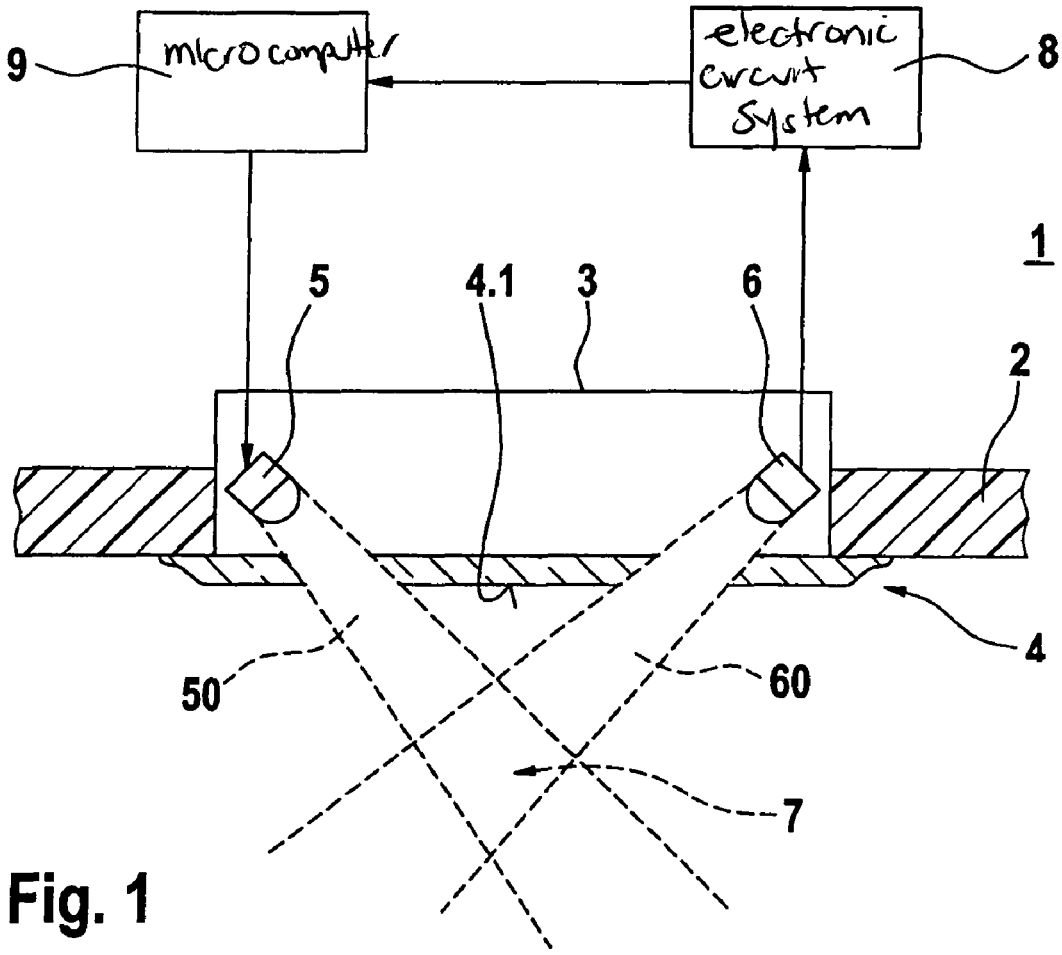
FIG. 1 shows the schematic construction of a fire detector according to the scattered light principle.

FIG. 1 shows the schematic construction of a ceiling-flush fire detector 1 according to the scattered radiation principle. Fire detector 1 includes a housing 3, which is positioned ceiling-flush in a corresponding recess of ceiling 2 of a room. The housing is covered by a cover plate 4. A radiation transmitter 5 and a radiation receiver 6 are situated in housing 3 in such a way that no radiation may reach radiation receiver 6 directly from radiation transmitter 5. Rather, they are situated in such a way that their beam paths 50, 60 intersect outside cover plate 4. This intersection area is referred to as scattering volume 7. If scattering particles enter this scattering volume 7 from smoke generated by a fire source, for example, then the radiation emitted by radiation transmitter 5 is scattered on the smoke. A part of the scattered radiation thus reaches radiation receiver 6. The quantity of scattered radiation which is scattered by smoke particles to radiation receiver 6 at a given brightness of radiation transmitter 5 is a function of the composition of the smoke (the particle size in particular), the color of the smoke, the wavelength of the radiation used, and the scattering angle. The scattering angle is understood as the angle between the optical axis of radiation transmitter 5 and the optical axis of radiation receiver 6. Radiation transmitter 5 is controlled by a microcomputer 9. Radiation receiver 6 is connected to an electronic circuit system 8, which includes an amplifier and a filter. The amplified scattered radiation signal may be input and analyzed by microcomputer 9 via an A/D converter (not shown here). If the scattered radiation signal exceeds a specific predefinable threshold, fire detector 1 triggers an alarm. This alarm is expediently relayed via a bus system to a fire alarm center, from which the fire department is then notified, for example.

Figure 2:
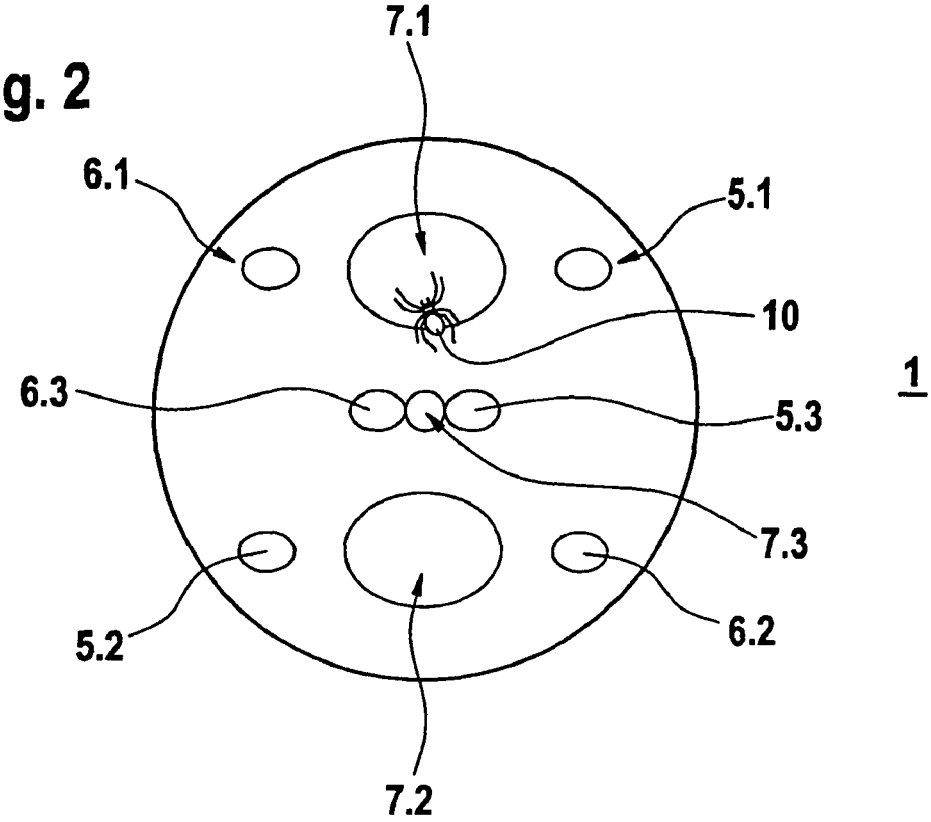
FIG. 2 shows the construction of a fire detector according to an example embodiment of the present invention.

A first example embodiment of a fire detector 1 according to the present invention is shown in FIG. 2. Fire detector 1 includes three radiation transmitters 5.1, 5.2, 5.3 and three radiation receivers 6.1, 6.2, 6.3.

Radiation transmitters 5.1, 5.2, 5.3 and radiation receivers 6.1, 6.2, 6.3 are situated in this case in such a way that their beam paths result in three different scattering volumes 7.1, 7.2, 7.3. First scattering volume 7.1 is formed by the beam paths of radiation transmitter 5.1 and radiation receiver 6.1. Second scattering volume 7.2 is formed by the beam paths of radiation transmitter 5.2 and radiation receiver 6.2. Third scattering volume 7.3 is formed by the beam paths of radiation transmitter 5.3 and radiation receiver 6.3. Radiation transmitter 5.1 and radiation receiver 6.1 are oriented in such a way that scattering volume 7.1, in which this system responds sensitively to smoke particles, is located several centimeters below cover plate 4 of fire detector 1, which is transparent to infrared light. Scattering volume 7.2 formed by the beam paths of radiation transmitter 5.2 and radiation receiver 6.2 may also be situated at a distance of several centimeters from cover plate 4. Alternatively, radiation transmitter 5.2 and radiation receiver 6.2 may also be oriented in such a way that scattering volume 7.2 has a larger or smaller distance from cover plate 4, however. Scattering volumes 7.1 and 7.2 are situated in this case in such a way that they do not overlap, but rather preferably are at a distance of several centimeters. Furthermore, radiation transmitter 5.2 and radiation receiver 6.2 are situated rotated by 180° in relation to radiation transmitter 5.1 and radiation receiver 6.1.

In addition, radiation transmitter 5.3 and radiation receiver 6.3 are oriented in such a way that scattering volume 7.3 formed by their beam paths includes at least a partial area of the surface of cover plate 4.

Figure 3:
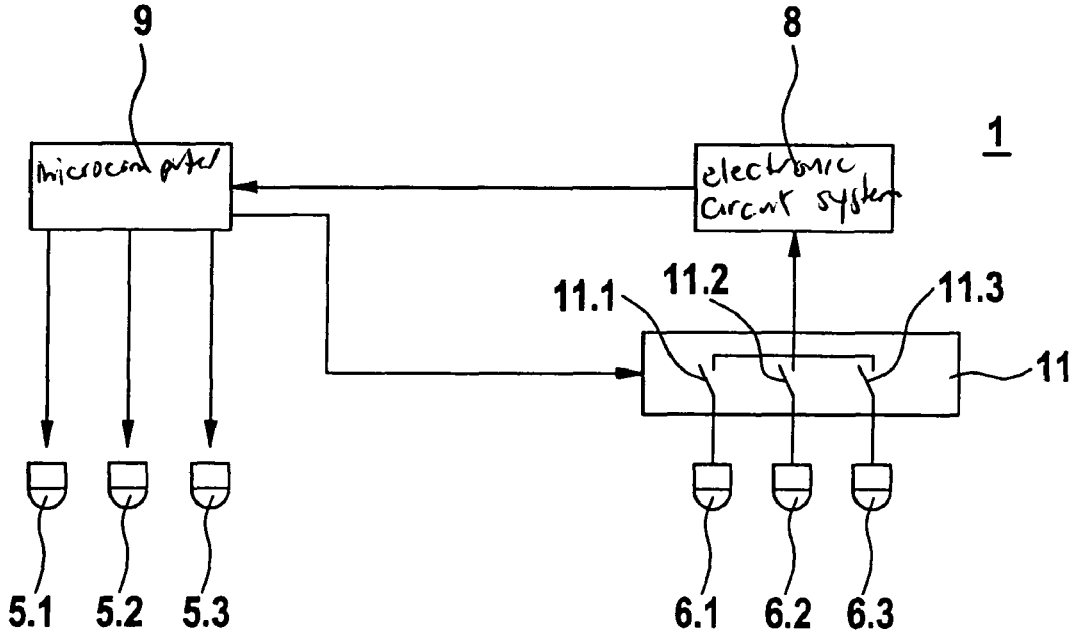
FIG. 3 shows a block diagram of a fire detector according to an example embodiment of the present invention.

A block diagram of fire detector 1 shown in FIG. 2 is illustrated in FIG. 3. Radiation transmitters 5.1, 5.2, 5.3 are connected to a microcomputer 9 which controls the radiation transmitters. Radiation receivers 6.1, 6.2, 6.3 are connected to switch 11 having multiple switch elements 11.1, 11.2, 11.3. In this case, the input terminal of each switch element 11.1, 11.2, 11.3 is connected to the associated radiation receiver 6.1, 6.2, 6.3. The output terminals of switch elements 11.1, 11.2, 11.3, which are connected to one another, are connected to the input terminal of an electronic circuit system 8. This circuit system includes a filter and an amplifier. The output terminal of electronic circuit system 8 is connected to the input terminal of microcomputer 9. Furthermore, a switch 11 is connected to microcomputer 9, which controls the switch 11.

Radiation transmitters 5.1, 5.2, 5.3 are controllable individually by microcomputer 9. Since switch 11 is also controllable by microcomputer 9, radiation transmitters 5.1, 5.2, 5.3 and radiation receivers 6.1, 6.2, 6.3 may be activated in any arbitrary predefinable combinations to jointly form scattering volumes.

The mode of operation of fire detector 1 according to the present invention is described below.

The following functions may be implemented as a function of which radiation transmitters 5.1, 5.2, 5.3 are controlled by microcomputer 9 and of which radiation receivers 6.1, 6.2, 6.3 are connected by switch 11 to electronic circuit system 8 at the instant at which radiation transmitters 5.1, 5.2, 5.3 emit radiation.

Figure 4:
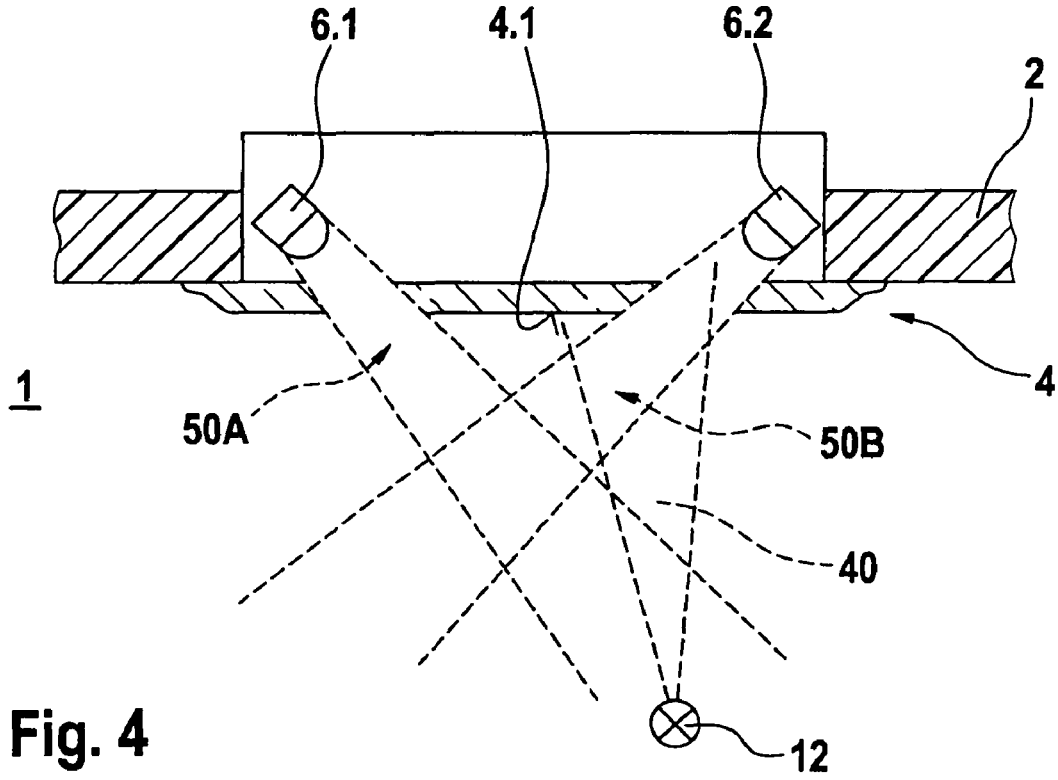
FIG. 4 shows a fire detector subject to interference from interfering radiation.

It is assumed that radiation is emitted by radiation transmitter 5.1 and received by radiation receiver 6.1 or radiation is emitted by radiation transmitter 5.2 and received by radiation receiver 6.2. In this case, the smoke density may be measured in scattering volume 7.1 and/or in scattering volume 7.2, which are located at a distance of several centimeters from the surface of cover plate 4. In the measurement using radiation transmitter 5.1 and radiation receiver 6.1, i.e., using scattering volume 7.1, a scattered radiation measured value S11 is obtained. In the measurement using radiation transmitter 5.2 and radiation receiver 6.2, i.e., using scattering volume 7.2, a scattered radiation measured value S22 is obtained. By comparing scattered radiation measured values S11 and S22, one may advantageously differentiate whether an interfering object, such as an insect 10 (FIG. 2), or smoke is located in front of fire detector 1. If an insect 10 is located in scattering volume 7.1 (FIG. 2), for example, scattered radiation measured value S11 is much larger than scattered radiation measured value S22, since a large amount of radiation is reflected on insect 10 located in scattering volume 7.1. In contrast, in the event of a fire, it may be assumed that smoke produced by the fire is distributed generally homogeneously in the comparatively small area in front of cover plate 4 of fire detector 1. However, this would have the result that scattered radiation measured value S11 would be approximately equally as large as scattered radiation measured value S22. In a first embodiment variation of the present invention, scattered radiation measured values S11, S22 are obtained essentially simultaneously. This is made possible by activating two scattered volumes 7.1 and 7.2 simultaneously. In turn, this is achieved in that radiation transmitters 5.1 and 5.2 and radiation receivers 6.1, 6.2, which form scattering volume 7.1 and 7.2 using their particular beam paths, are controlled simultaneously by microcomputer 9. In an alternative embodiment, scattered radiation measured values S11, S22 are obtained sequentially in time. For this purpose, only one scattering volume 7.1, 7.2 is activated at a time, by controlling one pair of radiation transmitter 5.1 and radiation receiver 6.1 or radiation transmitter 5.2 and radiation receiver 6.2, whose beam paths form scattering volumes 7.1, 7.2, via microcomputer 9. The latter variation also offers the advantage that temporary interference, which may be caused by a moving insect, for example, may be differentiated from permanent interference, such as soiling. A further advantage of both embodiment variations is their comparatively high insensitivity to interfering external light. This will be explained on the basis of FIG. 4. For example, radiation receiver 6.1 responds more strongly to external light if an external light source 12 is located in the solid angle range covered by the beam path of radiation receiver 6.1. Whether radiation receiver 6.1 is actually subject to interference from external light of an external light source 12 having beam path 40 may be determined easily by analyzing a measured signal of radiation receiver 6.1 when radiation transmitters 5.1, 5.2, 5.3 are not active. If a noticeable scattered radiation measured value S11 results during the measurement, this indicates interference by an external light source 12. Since, as illustrated in FIG. 2 and FIG. 4, radiation receiver 6.2 is situated offset by 180° in relation to radiation receiver 6.1 and fire detector 1, radiation receiver 6.2 is not impaired by external light source 12. This is used as a verification for radiation receiver 6.1 being interfered with by an external light source 12. In this case, however, fire detector 1 may still reliably detect smoke using scattering volume 7.2 and therefore fulfill its monitoring function. Without leaving the scope of the present invention, a fire detector 1 may, of course, also be expanded further. Thus, for example, it may operate using four different scattering volumes. In this case, the optical axes of the four radiation transmitters and radiation receivers now provided may each be situated rotated by approximately 90° from one another. This offers the additional advantage that interfering external light from multiple directions may be suppressed.

In the following, it is assumed that radiation transmitter 5.3 and radiation receiver 6.3 are activated. Since scattering volume 7.3 formed by the beam paths of radiation transmitter 5.3 and radiation receiver 6.3 encloses a partial area of the surface of cover plate 4, radiation of radiation transmitter 5.3 is reflected on cover plate 4 and thus reaches radiation receiver 6.3, which provides a scattered radiation measured value S33. Even if there is no dirt on cover plate 4, a certain part of the radiation emitted by radiation transmitter 5.3 will be reflected by cover plate 4 to radiation receiver 6.3 as a function of the angle of incidence of the radiation on cover plate 4. The intensity of radiation transmitter 5.3 may expediently be set in such a way that the idle signal of scattered radiation measured value S33 thus arising assumes a predefinable value. In contrast, if there is dirt in the area of scattering volume 7.3 on cover plate 4, additional radiation is reflected by the dirt, so that scattered radiation measured value S33 measured at radiation receiver 6.3 assumes a higher value. In this way, soiling of cover plate 4 may be recognized reliably.

A change in the ambient temperature or aging of radiation transmitter 5.3 may result in the idle signal of scattered radiation measured value S33 falling below its starting value. By calculating ratios between the original and the current idle signal, a correction factor KF may be derived in order to compensate for the intensity change of radiation transmitter 5.3. This is expediently performed by applying a current corrected by correction factor KF to radiation transmitter 5.3. Furthermore, a defect in radiation transmitter 5.3, radiation receiver 6.3, or electronic circuit system 8 may be recognized in that scattered radiation measured value S33*x* assumes a no longer measurable value. In order to guarantee a high operational reliability of the fire detector and reliably counteract gradual aging effects, a limiting value G is expediently predefined for scattered radiation measured value S33*x*. A value below this limiting value G is reported as a defect in fire detector 1.

Figure 5:
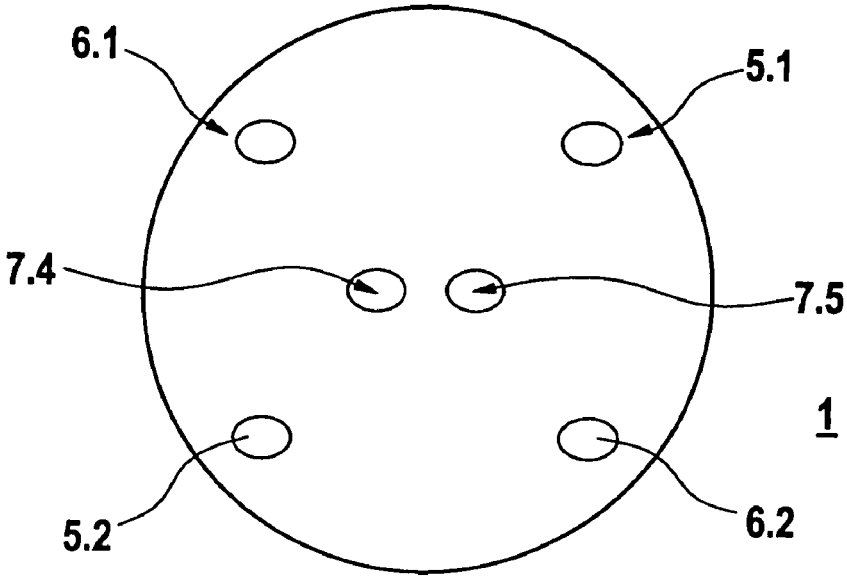
FIG. 5 shows the scattered radiation measurement in a fire detector according to an example embodiment of the present invention.
Figure 6:
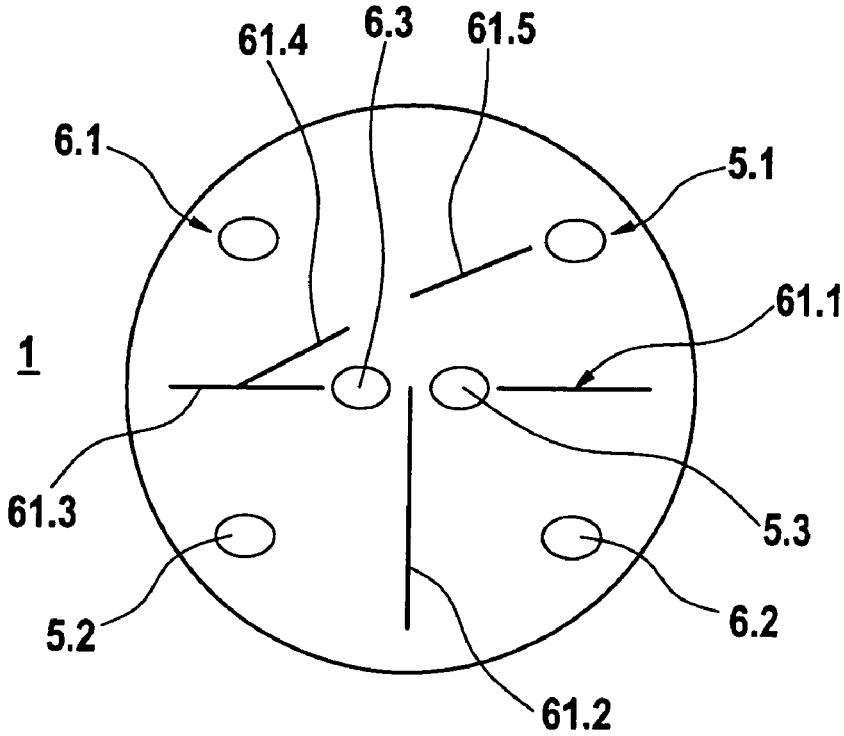
FIG. 6 shows the function monitoring of a radiation transmitter and a radiation receiver in a fire detector according to an example embodiment of the present invention.

In the following, it is assumed that radiation is emitted by radiation transmitter 5.1 and received by radiation receiver 6.2 or that radiation is emitted by radiation transmitter 5.2 and received by radiation receiver 6.1. As shown in FIG. 5, further areas in which fire detector 1 responds sensitively to smoke particles or other objects during the measurement result as a function of the orientation of radiation transmitters 5.1, 5.2 and radiation receivers 6.1, 6.2. Thus, upon activation of and measurement using radiation transmitter 5.2 and radiation receiver 6.1, a fourth scattering volume 7.4 results. A scattered radiation measured value S12 may be determined using this scattering volume. Upon activation of and measurement using radiation transmitter 5.1 and radiation receiver 6.2, a fourth scattering volume 7.5 results. A scattered radiation measured value S21 may be determined using this scattering volume 7.5. If radiation transmitters 5.1 and 5.2 were not rotated by 180° in relation to one another, further scattering volumes 7.4 and 7.5 would be identical.

It is a further advantage of fire detector 1 according to the present invention that two further independent scattering volumes 7.4, 7.5 result through the rotation of radiation transmitters 5.1, 5.2 by 180°. The orientation of radiation transmitters 5.1, 5.2 and radiation receivers 6.1, 6.2 may, for example, be selected so that scattering volumes 7.4, 7.5 formed by them have a greater distance from cover plate 4 of fire detector 1 than scattering volumes 7.1 and 7.2. A smaller scattering angle thus results for scattering volumes 7.4, 7.5 than for scattering volumes 7.1 and 7.2. By comparing scattered radiation measured values S12 and S21 to scattered radiation measured values S11 and S22, the following additional information may advantageously be obtained. It may not only be recognized whether smoke is located in front of fire detector 1 at all. Rather, it may additionally be determined what type of smoke or fire it is. Since, if a smaller scattering angle is predefined, generally less radiation is scattered than in the case of a large scattering angle, scattered radiation measured values S12 and S21 will typically be smaller than scattered radiation measured values S11 and S22 if smoke is present in front of fire detector 1. The reduction of the intensity of the scattered radiation as a function of the scattering angle is strongly dependent on the type of smoke, in particular on the size of the smoke particles and the color of the smoke. Therefore, by calculating quotients S12/S11, S21/S11, S12/S22, and S21/S22, it may be determined what type of smoke it is. This information may be used for the purpose of better differentiating between dangerous fire smoke and rather harmless disturbance variables, such as water vapor or dust. Furthermore, it may be recognized whether an object is located in front of fire detector 1 and at what distance. For example, if scattered radiation measured values S11, S12, S12, and S21 are approximately of the same magnitude, then this indicates that an object is located in front of fire detector 1. If the object is located at a greater distance from fire detector 1, scattered radiation measured values S12 and S21 which are much larger than scattered radiation measured values S11 and S22 result.

In the following, it is assumed that radiation is emitted by radiation transmitter 5.3 and received by radiation receiver 6.2 or radiation is transmitted by radiation transmitter 5.3 and received by radiation receiver 6.1 or radiation is transmitted by radiation transmitter 5.2 and received by radiation receiver 6.3.

Figure 7:
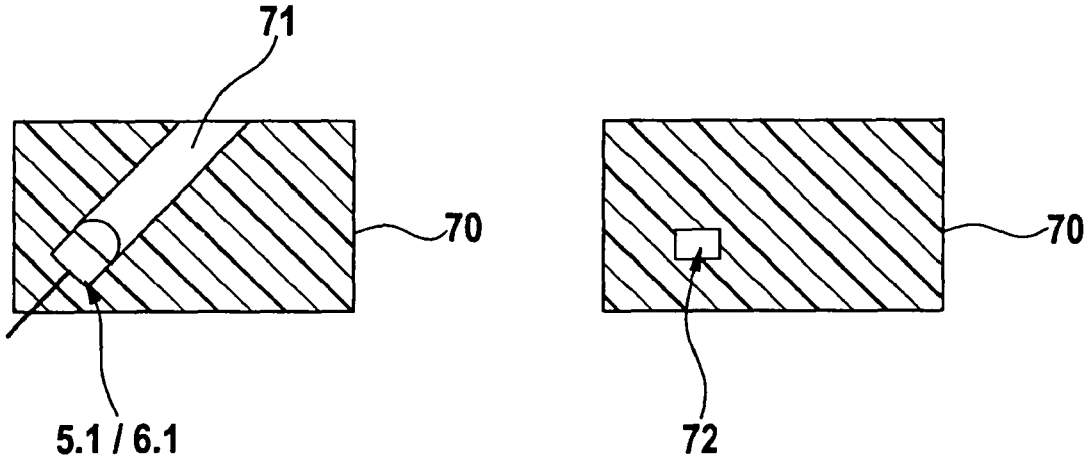
FIG. 7 shows the holder for radiation transmitters and radiation receivers in a fire detector according to an example embodiment of the present invention.

As shown in FIG. 7, radiation transmitters 5.1, 5.2, 5.3 and radiation receivers 6.1, 6.2, 6.3 are mounted in holders 70, which are preferably made of a material which does not reflect the radiation emitted by the radiation transmitters, in order to prevent interference through interference radiation. For example, they may be made of non-reflecting black-colored plastic material. For this purpose, recesses 71 are positioned in holders 70, which are oriented at an angle in relation to an external surface of holders 70. A predefinable emission angle and/or reception angle of radiation transmitters 5.1, 5.2, 5.3 and radiation receivers 6.1, 6.2, 6.3 mounted in holders 70 may thus be set. Furthermore, holders 70 are used for delimiting the solid angle in which a radiation transmitter 5.1, 5.2, 5.3 may emit radiation or from which a radiation receiver 6.1, 6.2, 6.3 may receive radiation. In this way, radiation transmitters 5.1, 5.2, 5.3 and radiation receivers 6.1, 6.2, 6.3 are shielded in such a way that radiation may leave radiation transmitters 5.1, 5.2, 5.3 only in a specific area around the optical axis of radiation transmitters 5.1, 5.2, 5.3 and radiation may reach radiation receivers 6.1, 6.2, 6.3 only in a specific area around the optical axis of radiation receivers 6.1, 6.2, 6.3. In this way, it is ensured that no radiation may reach radiation receivers 6.1, 6.2, 6.3 directly from radiation transmitters 5.1, 5.2, 5.3. Additional windows 72 may be introduced into these holders 70, through which radiation may be emitted by the radiation transmitters or received by the radiation receivers. In contrast to recesses 71, which are used for the scattered radiation measurement, i.e., from which radiation passes at a specific angle through cover plate 4 and leaves fire detector 1 and/or enters it, windows 72 are introduced laterally into holders 70, so that radiation exiting from these windows 72 and/or radiation entering these windows 72 propagates generally parallel to cover plate 4 and therefore does not leave the fire detector at all. The radiation exiting through these windows 72 and/or entering into these windows 72 is used for a function check of fire detector 1. In order that no radiation may reach radiation receiver 6.2 directly from radiation receiver 5.1 through windows 72 provided for the function check of fire detector 1 (and/or from radiation transmitter 5.2 to radiation receiver 6.1, or from radiation transmitter 5.1 to radiation receiver 6.1, and/or from radiation transmitter 5.2 to radiation receiver 6.2), screens 61.1, 61.2, 61.3, 61.4, 61.5 are situated within fire detector 1, which suppress direct propagation of radiation between radiation transmitter 5.1 and radiation receiver 6.2 (and/or between radiation transmitter 5.2 and radiation receiver 6.1, or from radiation transmitter 5.1 to radiation receiver 6.1, and/or from radiation transmitter 5.2 to radiation receiver 6.2). If radiation transmitter 5.1 is now controlled by microcomputer 9, for example, it may be measured using radiation receiver 6.3 whether radiation transmitter 5.1 still operates correctly.

Radiation transmitter 5.2 and radiation receivers 6.2 and 6.3 may be checked analogously. In addition to the function check of radiation transmitters and radiation receivers explained above, the combinations of radiation transmitters and radiation receivers cited here and/or the scattering volumes formed by their beam paths may additionally also be used for a scattered radiation measurement.

What is claimed is:

1. A fire detector, for detecting smoke, comprising:

a first radiation transmitter and a first radiation receiver having a first beam path that forms a first scattering volume;

a second radiation transmitter and a second radiation receiver having a second beam path that is parallel to the first beam path and forms a second scattering volume, wherein the first scattering volume and the second scattering volume are spatially separated and do not overlap, wherein the first radiation transmitter and the second radiation transmitter are oriented by an angle of 180° from one another, and wherein the first radiation receiver and the second radiation receiver are oriented 180° from one another; and a microcomputer to selectably control the first radiation transmitter and the second radiation transmitter, the microcomputer analyzing the first scattering volume and the second scattering volume through an analog-to-digital converter.

2. The fire detector as recited in claim 1, wherein the fire detector is configured to be installed flush with a ceiling.

3. The fire detector as recited in claim 1, wherein the fire detector is covered by a cover plate.

4. The fire detector as recited in claim 1, wherein the fire detector does not include an optical labyrinth.

5. The fire detector as recited in claim 1, wherein the first and second scattering volumes are at different distances from the cover plate.

6. The fire detector as recited in claim 1, further comprising:

a third radiation transmitter and a third radiation receiver have a beam path that forms a third scattering volume, the third scattering volume including at least a partial area of the surface of the cover plate covering the fire detector.

7. The fire detector as recited in claim 1, wherein the first and second beam paths are oriented rotated by an angle from one another.

8. The fire detector as recited in claim 1, wherein the first and second beam paths of the first and second radiation transmitters and the first and second radiation receivers form two additional scattering volumes.

9. The fire detector as recited in claim 8, wherein the two additional scattering volumes are situated at different distances from the surface of a cover plate of the fire detector.

10. The fire detector as recited in claim 9, wherein the two additional scattering volumes have a larger distance from a cover plate of the fire detector than the first scattering volume and the second scattering volume in such a way that a smaller scattering angle results for a scattering action on the two additional scattering volumes.

11. The fire detector as recited in claim 1, further comprising:

holders configured to accommodate the first and second radiation transmitters and the first and second radiation receivers.

12. The fire detector as recited in claim 11, wherein the holders have angularly situated recesses for mounting the first and second radiation transmitters and first and second radiation receivers at a predefinable angle relates to a surface of the holder.

13. The fire detector as recited in claim 11, wherein the holders have windows which allow passage of radiation.

14. The fire detector as recited in claim 11, wherein the holders are made of a material that absorbs radiation emitted by the radiation transmitter.

15. A method for operating a fire detector, the method comprising:

a second radiation transmitter and a second radiation receiver having a second beam path that is parallel to the first beam path and forms a second scattering volume, wherein the first scattering volume and the second scattering volume are spatially separated and do not overlap, wherein the first radiation transmitter and the second radiation transmitter are oriented by an angle of 180° from one another, and wherein the first radiation receiver and the second radiation receiver are oriented 180° from one another; checking the fire detector for operability; performing a function check of a set of transmitters and a set of receivers; obtaining scattered radiation measured values from two different scattering volumes formed from parallel beam paths of the set of transmitters and receivers; comparing the scattered radiation measured values to one another; inferring a presence of smoke and a source of fire if the scattered radiation measured values are generally equal; determining a type, a size, a distance and a color of the smoke; and inferring a presence of an interfering body in a scattering volume if the scattered radiation measured values deviate from one another.

16. The method as recited in claim 15, wherein the scattered radiation measured values are obtained generally simultaneously from at least two simultaneously activated scattering volumes.

17. The method as recited in claim 15, wherein the scattered radiation measured values are obtained sequentially in time from alternately activated scattering volumes.

18. The method as recited in claim 15, wherein at least one of the scattering volumes includes at least partial areas of a surface of a cover plate which covers the fire detector and is formed by beam paths of at least one radiation transmitter and at least one radiation receiver, a first scattered radiation measured value being obtained by activating the radiation transmitter and the radiation receiver at a first instant when the surface of the cover plate is clean, and the first scattered radiation measured value being predefined as an idle signal characterizing a clean cover plate.

19. The method as recited in claim 18, wherein a second scattered radiation measured value obtained at a second, later instant is compared to the first scattered radiation measured value obtained at the first instant, and soiling of the cover plate is inferred if the second scattered radiation measured value is greater than the first scattered radiation measured value.

20. The method as recited in claim 19, wherein a limiting value is predefinable for the second scattered radiation measured value, and maintenance of the fire detector is requested if the limiting value is exceeded.

21. The method as recited in claim 15, wherein, if a scattered radiation measured value obtained at a later instant falls below a scattered radiation measured value obtained at a first instant, one of: i) a change of ambient temperature, and ii) aging of a radiation transmitter is inferred.

22. The method as recited in claim 21, further comprising: deriving a correction factor using a quotient calculation of the scattered radiation values.

23. The method as recited in claim 22, further comprising: applying to a radiation transmitter a current corrected by the correction factor.

24. The method as recited in claim 15, wherein scattered radiation measured values are obtained from scattering volumes which are at different distances from a cover plate of the fire detector.

25. The method as recited in claim 15, further comprising: comparing the scattered radiation measured values to determine a type of smoke and to recognize objects.

26. The method as recited in claim 25, wherein the comparison is performed by calculating quotients between the scattered radiation measured values.

27. The method as recited in claim 15, further comprising: selectively controlling radiation transmitters and radiation receivers of the fire detector, radiation emitted from a selectively controlled radiation transmitter being conducted to a selectively controlled radiation receiver within the fire detector.

28. The fire detector as recited in claim 1, electronic circuit system filters and amplifies a signal sent by one of the first radiation receiver and the second radiation receiver.

29. The fire detector as recited in claim 1, further comprising:

a switching arrangement connecting the first radiation receiver and the second radiation receiver to an electronic circuit system only when the first radiation transmitter and the second radiation transmitter emit radiation.

* * * * *